US010578091B2

(12) United States Patent
Bagagli et al.

(10) Patent No.: US 10,578,091 B2
(45) Date of Patent: Mar. 3, 2020

(54) FLUID FLOW ADAPTER FOR A CYLINDER OF A RECIPROCATING COMPRESSOR

(71) Applicant: Nuovo Pignone Srl, Florence (IT)

(72) Inventors: Riccardo Bagagli, Florence (IT); Leonardo Tognarelli, Florence (IT); Alberto Babbini, Florence (IT); Massimo Bargiacchi, Florence (IT); Guido Pratelli, Florence (IT); Federico Puccinelli, Florence (IT); Riccardo Maleci, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 104 days.

(21) Appl. No.: 15/536,233

(22) PCT Filed: Nov. 24, 2015

(86) PCT No.: PCT/EP2015/077468
§ 371 (c)(1),
(2) Date: Jun. 15, 2017

(87) PCT Pub. No.: WO2016/096331
PCT Pub. Date: Jun. 23, 2016

(65) Prior Publication Data

US 2017/0350380 A1 Dec. 7, 2017

(30) Foreign Application Priority Data

Dec. 15, 2014 (IT) ..... MI2014A2137

(51) Int. Cl.
*F04B 39/12* (2006.01)
*F04B 39/10* (2006.01)

(52) U.S. Cl.
CPC ..... *F04B 39/1053* (2013.01); *F04B 39/123* (2013.01)

(58) Field of Classification Search
CPC F04B 39/1053; F04B 39/1013; F04B 39/102; F04B 39/1026
See application file for complete search history.

(56) References Cited

U.S. PATENT DOCUMENTS

2010/0040484 A1 2/2010 Shade et al.
2013/0019955 A1* 1/2013 Bagagli ..... F04B 39/10 137/12

(Continued)

FOREIGN PATENT DOCUMENTS

WO 2009/010039 A3 3/2009

OTHER PUBLICATIONS

Italian Search Report and Written Opinion issued in connection with corresponding IT Application No. MI2014A002137 dated Sep. 2, 2015.

(Continued)

*Primary Examiner* — Patrick Hamo
(74) *Attorney, Agent, or Firm* — Baker Hughes Patent Organization

(57) ABSTRACT

Fluid flow adapter for a cylinder of a reciprocating compressor, the cylinder having a side wall provided with a valve seat, the fluid flow adapter comprising a filler element having an internal surface facing an internal volume of the cylinder and an external surface facing the valve, the filler element having at least a channel connecting the internal surface to the external surface, wherein the internal surface is flush with the side wall of the cylinder, the channel being configured to allow the passage of fluid between the internal volume of the cylinder and the valve.

11 Claims, 2 Drawing Sheets

(56) References Cited

U.S. PATENT DOCUMENTS

| | | | | |
|---|---|---|---|---|
| 2014/0014190 | A1* | 1/2014 | Bagagli | F04B 39/10 137/12 |
| 2014/0338761 | A1* | 11/2014 | Babbini | F04B 39/102 137/382 |
| 2015/0044081 | A1* | 2/2015 | Babbini | F16K 15/08 417/559 |

OTHER PUBLICATIONS

International Search Report and Written Opinion issued in connection with corresponding PCT Application No. PCT/EP2015/077468 dated Feb. 2, 2016.

International Preliminary Report on Patentability issued in connection with corresponding PCT Application No. PCT/EP2015/077468 dated Jun. 20, 2017.

* cited by examiner

FLUID FLOW ADAPTER FOR A CYLINDER OF A RECIPROCATING COMPRESSOR

BACKGROUND TO THE INVENTION

The present invention relates to a fluid flow adapter for a cylinder of a reciprocating compressor. Specifically, the invention relates to a device that can optimize the fluid flow in the proximity of a valve seat.

According to the state of the art a cylinder of a reciprocating compressor has a cylindrical side wall, in which a valve seat is machined. A valve is installed inside the valve seat. However, after the installation of the valve, a part of the volume of the valve seat remains empty, thus defining a pocket inside the cylinder. Indeed, such pocket is fluidodynamically continuous with the internal volume of the cylinder. In other words, the pocket defines an extension of the volume of the cylinder.

Disadvantageously, the presence of the pocket lowers the volumetric efficiency of the cylinder, thus reducing the amount of gas delivered. Also, the flow of fluid from/to the valve is impaired, as the irregular shape of the pocket causes turbulence which further reduces the compressor efficiency.

BRIEF DESCRIPTION OF THE INVENTION

A first embodiment of the present invention therefore relates to a fluid flow adapter for a cylinder of a reciprocating compressor. The cylinder, which is not part of the invention, has a side wall which is provided with a valve seat. The fluid flow adapter comprises a filler element which has an internal surface facing an internal volume of the cylinder. The filler element also has an external surface facing the valve. Also, the filler element has at least a channel which connects the internal surface to the external surface. The internal surface is flush with the side wall of the cylinder. In other words, the internal surface is level with the side wall of the cylinder. The channel is configured to allow the passage of fluid between the internal volume of the cylinder and the valve.

This allows to optimize the fluid path, defined in part by the channel inside the filler element.

BRIEF DESCRIPTION OF THE DRAWINGS

Further details and specific embodiments will refer to the attached drawings, in which.

DETAILED DESCRIPTION

Figure 1:
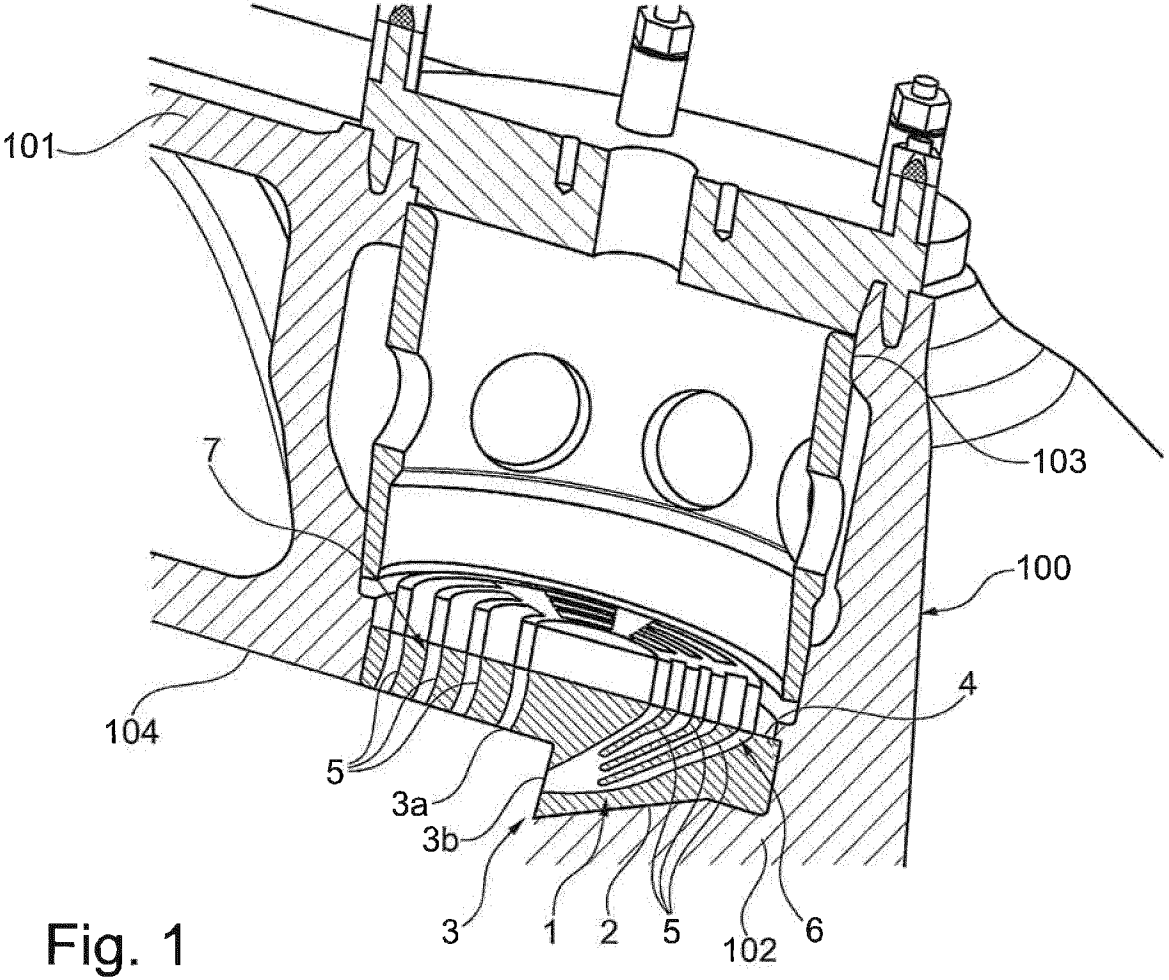
FIG. 1 is a perspective view of a fluid flow adapter for a cylinder of a reciprocating compressor according to a first embodiment of the present invention.

The following description of exemplary embodiments refers to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

With reference to the attached drawings, with the number 1 is indicated a fluid flow adapter for a cylinder of a reciprocating compressor according to an embodiment of the present invention. The cylinder itself will be indicated with the number 100, and is not part of this embodiment of the present invention. Therefore, the cylinder 100 will be described briefly for ease of reference.

The cylinder 100 has a side wall 101. The cylinder also has an end wall 102 transversal, and in an embodiment of the invention perpendicular, to the side wall 101. Inside the cylinder 100 is defined an internal volume 104.

A valve seat 103 is located on the side wall 101. In other words, the valve seat 103 is located on the side of the cylinder 100. The valve seat 103 is continuous with the internal volume 104 of the cylinder 100. Moreover, as shown for example in FIG. 1, the valve seat 103 of the cylinder 100 is located at an intersection of the side wall 101 and of the end wall 102.

A valve, not shown in the drawings, is inserted into the valve seat 103. When such valve is inserted into the valve seat 103 Therefore, once the cylinder 100 is assembled together with the valve, a pocket 105 of volume is still present. Such pocket 105 is continuous with the internal volume 104 of the cylinder 100.

The fluid flow adapter 1 comprises a filler element 2. The filler element 2 has an internal surface 3 which, in operation, faces the internal volume 104 of the cylinder 100. The filler element 2 also has an external surface 4 which, in operation, faces the valve. Such filler element 2 has a shape so that it fits precisely in the pocket 105 of the cylinder 100.

The filler element 2 has at least a channel 5, which connects the internal surface 3 to the external surface 4. Such channel 5 has the purpose of guiding a fluid flow in and/or out of the cylinder 100. In other words, the channel 5 is configured to allow the passage of fluid between the internal volume 104 of the cylinder 100 and the valve 8. The channel 5 defines a path for the fluid inside the filler element 2. In an embodiment of the invention, such path is fluidodynamically optimized. Indeed, such path could be easily defined as the envelop of all the optimum sections duct along its path from the valve to the cylinder (suction valve) and vice versa for discharge valve. This design of the flow path therefore reduces losses and vortexes. Also, as a consequence, the sizing of the minimum required volume to reach the cylinder 100 will allow the reduction of clearance volume to the minimum required volume for fluidynamic efficiency. For the transit of the fluid during operation of the cylinder 101. More detail on the shape and on the function of the channel 5 will be given in a following part of the present disclosure.

With more detail, the internal surface 3 is flush with the side wall 101 of the cylinder 100. Moreover, the internal surface 3 of the filler element 2 is flush with the end wall 102 of the cylinder 100. Within the context of the present disclosure the term "flush" is intended to mean "on the same level with", implying that two surfaces can be considered each as a continuation of the other, without substantial discontinuities. In other words, there are no "breaks" or "steps" between two such surfaces.

With more detail, the internal surface 3 of the filler element 2 comprises a cylindrical surface 3*a* and a flat surface 3*b*.

The cylindrical surface 3*a* is shaped as a portion of a lateral surface of a geometric cylinder. Also, the cylindrical surface 3*a* of the filler element 2 is flush with the side wall 101 of the cylinder 100. Indeed, the cylindrical surface 3*a* is shaped so that it fills the missing portion of the side wall 101 of the cylinder 100.

In the same way, the flat surface 3*b* has a substantially planar shape, so that it can fill the missing portion of the end wall 102 of the cylinder 100. The flat surface 3*b* is flush with the end wall 102 of the cylinder 100.

Figure 2:
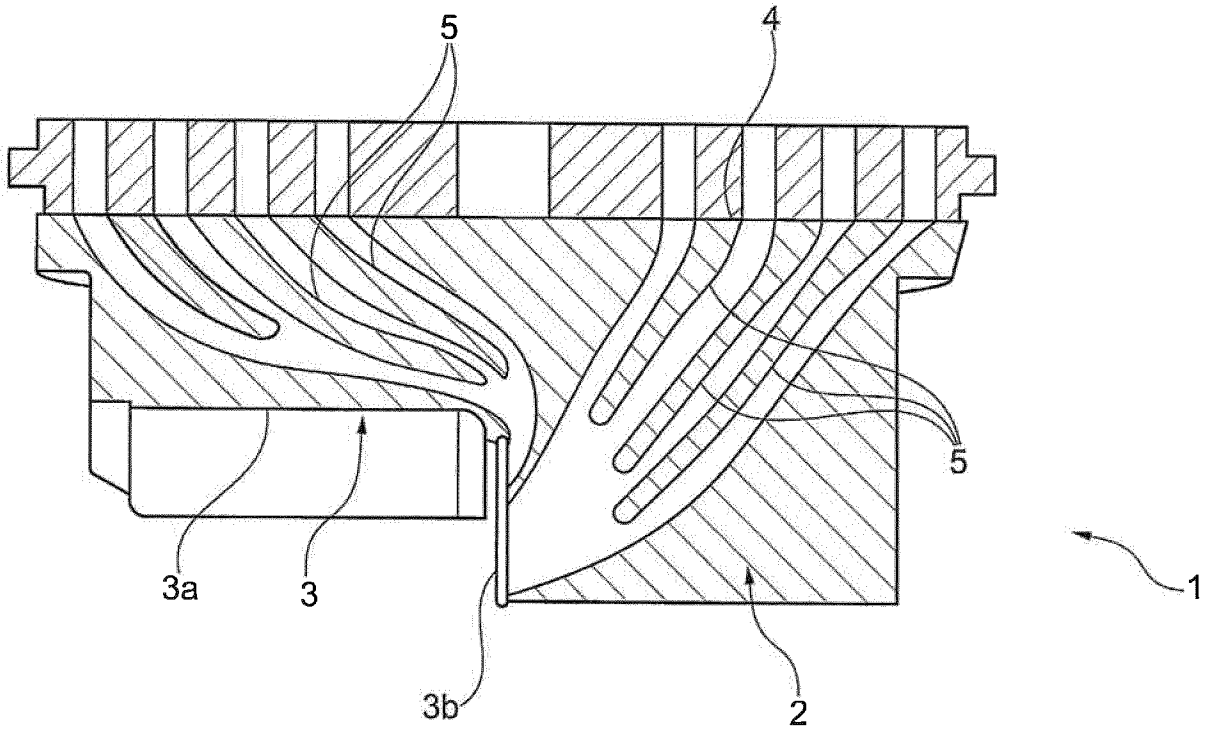
FIG. 2 is a side sectional view of a fluid flow adapter for a cylinder of a reciprocating compressor according to a first embodiment of the present invention.

As shown for in FIGS. 1 and 2, the adapter 1 comprises a plurality of channels 5. Each channel 5 ends on both the internal surface 3 and on the external surface 4.

With reference to an embodiment of the invention shown in FIG. 2, please note that all channels 5 end on the flat surface 3*b* of the filler element 2.

In an embodiment, shown in FIG. 1, a first group 6 of channels 5 ends on the on the flat surface 3*b* of the filler element 3. A second group 7 of channels 5 ends on the cylindrical surface 3*a* of the filler element 2.

The filler element 2 can be secured in place through any possible kind of connections like thread, forcing or adhesive. In an alternative embodiment, it can be directly machined as part of the valve. In a further alternative embodiment, the filler element 2 and the valve seat 103 in the cylinder 100 can lock onto each other as a mechanic fitting. In an embodiment of the invention, such fitting doesn't require any additional stops like screws or pins.

According to an embodiment of the invention, the filler element 2 is made by casting. Alternatively, the filler element 2 can be made by additive manufacturing. As a further alternative embodiment, the filler element 2 can also be made by machining. Other embodiments can also be made by any production process that combines the casting, additive manufacturing or machining processes.

An embodiment of the invention relates to a reciprocating compressor comprising at least a cylinder 100 as described above.

Finally, a reciprocating compressor according to the state of the art can be upgraded with a suitably constructed adapter 1.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A fluid flow adapter for a cylinder of a reciprocating compressor, comprising:

a valve seat configured to receive a valve; and a filler element comprising an internal surface facing an internal volume of the cylinder and flush with a side wall of the cylinder, an external surface facing the valve, and a plurality of channels configured to allow the passage of fluid between an internal volume of the cylinder and the valve, the plurality of channels comprising a first group of channels ending on a flat surface of the filler element and a second group of channels ending on a cylindrical surface of the filler element.

2. The adapter according to claim 1, wherein the cylinder has an end and the internal surface of the filler element is flush with the end wall.

3. The adapter according to claim 1, wherein the valve seat of the cylinder is located at an intersection of the side wall and of the end wall of the cylinder, the internal surface of the filler element comprising the cylindrical surface and the flat surface.

4. The adapter according to claim 3, wherein the cylindrical surface of the filler element is flush with the side wall of the cylinder.

5. The adapter according to claim 3, wherein the flat surface is flush with the end wall of the cylinder.

6. The adapter according to claim 1, wherein the plurality of channel defines a path for the fluid inside the filler element, the path being fluidodynamically optimized for the transit of the fluid during operation of the cylinder.

7. The adapter according to claim 1, wherein the filler element is made by casting.

8. The adapter according to claim 1, wherein the filler element is made by additive manufacturing.

9. A reciprocating compressor comprising:

at least a cylinder comprising a side wall and defining an internal volume; and a fluid flow adapter comprising:

a valve seat configured to receive a valve; and a filler element comprising an internal surface facing the internal volume of the cylinder, an external surface facing the valve, and a plurality of channels configured to allow the passage of fluid between the internal volume of the cylinder and the valve, the plurality of channels comprising a first group of channels ending on a flat surface of the filler element and a second group of channels ending on a cylindrical surface of the filler element.

10. The adaptor according to claim 9, wherein the adaptor is placed in an existing reciprocating compressor to upgrade the reciprocating compressor.

11. A fluid flow adapter for a cylinder of a reciprocating compressor, the cylinder comprising a side wall and defining an internal volume, the fluid flow adapter comprising:

a valve seat configured to receive a valve; and a filler element comprising an internal surface facing the internal volume of the cylinder, an external surface facing the valve, a first group of channels ending on a flat surface of the filler element and a second group of channels ending on a cylindrical surface of the filler element, the first group of channels and the second group of channels configured to allow the passage of fluid between the internal volume of the cylinder and the valve.

* * * * *